US011744331B2

(12) United States Patent
Myerscough et al.

(10) Patent No.: US 11,744,331 B2
(45) Date of Patent: Sep. 5, 2023

(54) METHOD OF SEALING A ZIPPER CLOSURE AND A SEALED ZIPPER ASSEMBLY

(71) Applicant: YKK (U.S.A.) Inc., Marietta, GA (US)

(72) Inventors: Richard Kerr Myerscough, Victoria (CA); Ross Davis Harrington, Victoria (CA)

(73) Assignee: YKK (U.S.A.) Inc., Marietta, GA (US)

( * ) Notice: Subject to any disclaimer, the term of this patent is extended or adjusted under 35 U.S.C. 154(b) by 0 days.

(21) Appl. No.: 17/389,557

(22) Filed: Jul. 30, 2021

(65) Prior Publication Data

US 2021/0353012 A1 Nov. 18, 2021

Related U.S. Application Data

(63) Continuation of application No. 16/300,209, filed as application No. PCT/CA2017/050477 on Apr. 18, 2017, now Pat. No. 11,116,291.

(60) Provisional application No. 62/334,732, filed on May 11, 2016.

(51) Int. Cl.
*A44B 19/32* (2006.01)
*A44B 19/36* (2006.01)

(52) U.S. Cl.
CPC ..... *A44B 19/32* (2013.01); *A44B 19/36* (2013.01)

(58) Field of Classification Search
CPC ..... A44B 19/32; A44B 19/36; Y10T 24/2505
See application file for complete search history.

(56) References Cited

U.S. PATENT DOCUMENTS

| | | | |
|---|---|---|---|
| 2,347,583 | A | 4/1944 | Vartabedian |
| 2,454,214 | A | 11/1948 | Sapp |
| 2,615,224 | A | 10/1952 | Shur |
| 2,641,037 | A | 6/1953 | Gossner |
| 2,693,013 | A | 11/1954 | Gossner |
| 2,746,114 | A | 5/1956 | Williams |
| 2,841,851 | A | 7/1958 | Amburg et al. |
| 3,102,570 | A | 9/1963 | Fairchilds |
| 5,062,186 | A | 11/1991 | Rampolla et al. |
| 6,092,266 | A | 7/2000 | Lee |
| 6,223,349 | B1 | 5/2001 | Roiser |
| 11,033,081 | B2 | 6/2021 | Myerscough et al. |
| 2013/0133129 | A1 | 5/2013 | Martin |
| 2016/0021990 | A1 | 1/2016 | Ogura et al. |

FOREIGN PATENT DOCUMENTS

| | | | |
|---|---|---|---|
| CN | 103945724 | A | 7/2014 |
| CN | 203748781 | U | 8/2014 |
| EP | 1057424 | A2 | 12/2000 |

(Continued)

OTHER PUBLICATIONS

Office Action, European Patent Application No. 17795214.0, dated Sep. 7, 2021, 5 pages.

(Continued)

*Primary Examiner* — Robert Sandy
*Assistant Examiner* — Louis A Mercado
(74) *Attorney, Agent, or Firm* — Kilpatrick Townsend & Stockton LLP

(57) ABSTRACT

A sealed zipper assembly includes a first zipper segment and a second zipper segment in overlapping relation to create a sealing zone. A sealing element is positioned in the sealing zone to prevent leakage between the first zipper segment and the second zipper segment.

20 Claims, 13 Drawing Sheets

(56) References Cited

FOREIGN PATENT DOCUMENTS

| | | | |
|---|---|---|---|
| EP | 1481601 | A2 | 12/2004 |
| GB | 557418 | A | 11/1943 |
| GB | 2094396 | A | 9/1982 |
| WO | 2011127353 | A1 | 10/2011 |

OTHER PUBLICATIONS

International Search Report, PCT Patent Application No. PCT/CA2017/050477, dated Jul. 25, 2017.
Written Opinion, PCT Patent Application No. PCT/CA2017/050477, dated Jul. 25, 2017.
U.S. Appl. No. 16/734,670 , Non-Final Office Action, dated Sep. 17, 2020, 8 pages.
U.S. Appl. No. 16/734,670 , Notice of Allowance, dated Jan. 19, 2021, 7 pages.
Office Action, Chinese Patent Application No. 201780035087.8, dated Dec. 16, 2020, 4 pages.
Office Action, European Patent Application No. 17795214.0, dated Jan. 25, 2021, 4 pages.
Office Action, European Patent Application No. 17795214.0, dated Jun. 17, 2020, 5 pages.
U.S. Appl. No. 16/300,209, Non-Final Office Action, dated Jul. 24, 2020, 7 pages.
U.S. Appl. No. 16/300,209 , Final Office Action, dated Jan. 8, 2021, 8 pages.
U.S. Appl. No. 16/300,209 , Notice of Allowance, dated May 28, 2021, 8 pages.

METHOD OF SEALING A ZIPPER CLOSURE AND A SEALED ZIPPER ASSEMBLY

REFERENCE TO RELATED APPLICATIONS

This application is a continuation of U.S. application Ser. No. 16/300,209, filed on Nov. 9, 2018, now U.S. Pat. No. 11,116,291, and entitled METHOD OF SEALING A ZIPPER CLOSURE AND A SEALED ZIPPER ASSEMBLY, which is the national stage entry of International Application No. PCT/CA2017/050477, filed Apr. 18, 2017, and entitled METHOD OF SEALING A ZIPPER CLOSURE AND A SEALED ZIPPER ASSEMBLY, which claims the benefit of U.S. Provisional Application No. 62/334,732, filed on May 11, 2016, all of which are hereby incorporated by reference in their entireties.

FIELD OF THE INVENTION

There is described a method of sealing a zipper closure and a sealed zipper assembly that can be used in applications involving liquids or potentially harmful gases.

BACKGROUND

EP Patent specification 1,481,601 (Kallionpaa) titled "Closure for zipper ends", discloses a sealing mechanism for a zipper closure. However, the sealing mechanism taught by the Kallionpaa reference is not ideal. The sealing mechanism is complicated to use and the material around the sealing mechanism tends to become fatigued, eventually leading to failure. The bulk of the sealing mechanism is uncomfortable to wear in some applications. There is, therefore, a need for an alternative method of sealing a zipper closure and an alternative sealed zipper assembly.

SUMMARY

According to one aspect there is provided a method of sealing a zipper closure. A step is taken of providing a first zipper segment and a second zipper segment in overlapping relation to create at least one sealing zone. A further step is taken of positioning a sealing element in the at least one sealing zone to prevent leakage between the first zipper segment and the second zipper segment.

According to another aspect there is provided a sealed zipper assembly which includes a first zipper segment and a second zipper segment in overlapping relation to create at least one sealing zone. A sealing element is positioned in the at least one sealing zone to prevent leakage between the first zipper segment and the second zipper segment.

It will be appreciated that the sealing element used may vary. There will hereinafter be described with reference to the drawings various alternative sealing elements. One sealing element is a resiliently deformable sealing element that is compressed within the sealing zone. Another sealing element is an expandable sealing element that expands to occupy the sealing zone. Yet another sealing element is a plug that is wedged into the at least one sealing zone. Yet another sealing element is plug that can be compressed lengthwise via an internal screw tensioner.

It will also be appreciated, that the assembly may involve differing numbers of interlocking zipper fasteners. There will hereinafter be described a first embodiment in which there is a single interlocking zipper fastener and a single sealing zone. The single interlocking zipper fastener has a first series of interlocking teeth and a second series of interlocking teeth and a least one slider. The single interlocking zipper fastener has a first end that serves as the first zipper segment and a second end that serves as the second zipper segment. There will hereinafter be described another embodiment in which there is more than one interlocking zipper fastener and more than one sealing zone. Each interlocking zipper fastener has a first end and a second end. The first end of one interlocking zipper fastener serves as the first zipper segment and the second end of another interlocking zipper fastener serves as the second zipper segment.

It will also be appreciated that when the first zipper segment and the second zipper segment are overlapping, they are not necessarily parallel to the one or more interlocking zipper fasteners. There will hereinafter be described an embodiment in which the first zipper segment and the second zipper segment, which form the at least one sealing zone, project outwardly from the one or more interlocking zipper fasteners. In a circular configuration, this might be described as projecting radially.

The method of sealing a zipper closure and the sealed zipper assembly will hereinafter be described with respect to embodiment in which one or more interlocking zipper fastener are arranged in a substantially circular configuration. This configuration is the one that was developed for the applicant's intended application. It will be appreciated that the teachings are equally applicable to linear applications.

BRIEF DESCRIPTION OF THE DRAWINGS

These and other features will become more apparent from the following description in which reference is made to the appended drawings, the drawings are for the purpose of illustration only and are not intended to be in any way limiting, wherein.

DETAILED DESCRIPTION

A first embodiment of sealed zipper assembly will now be described with reference to FIG. 1 through FIG. 11. Embodiment variations will be described with reference to FIG. 12 through FIG. 26.

Figure 6:
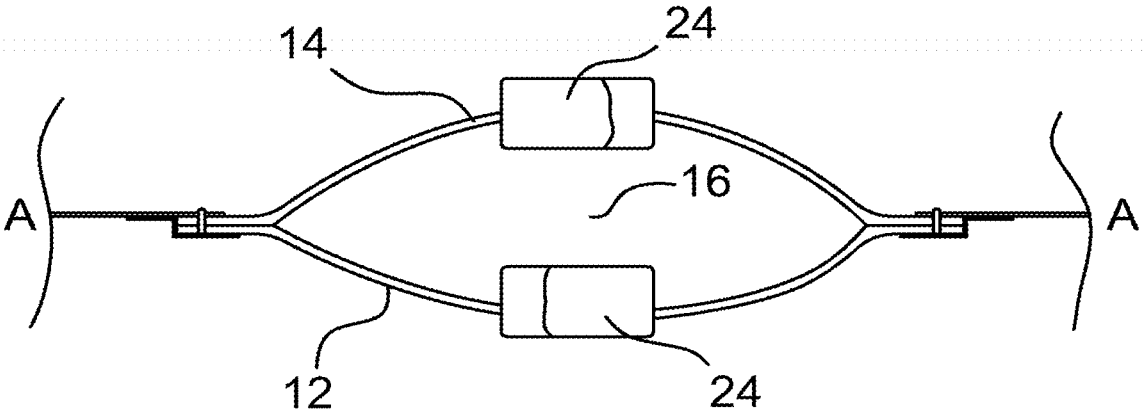
FIG. 6 is a section view of the first embodiment of sealed zipper assembly taken along section lines A-A of FIG. 1.
Figure 9:
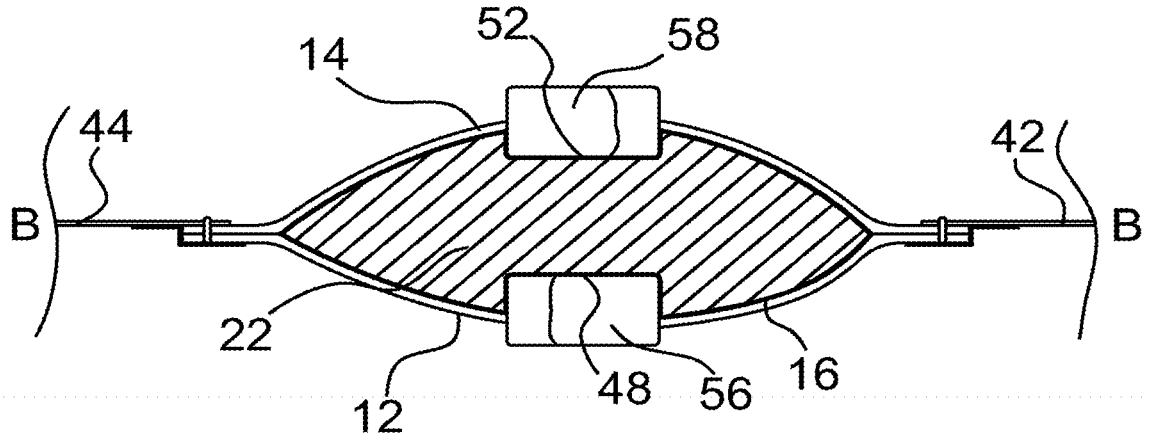
FIG. 9 is a section view of the first embodiment of sealed zipper assembly taken along section lines B-B of FIG. 8.
Figure 10:
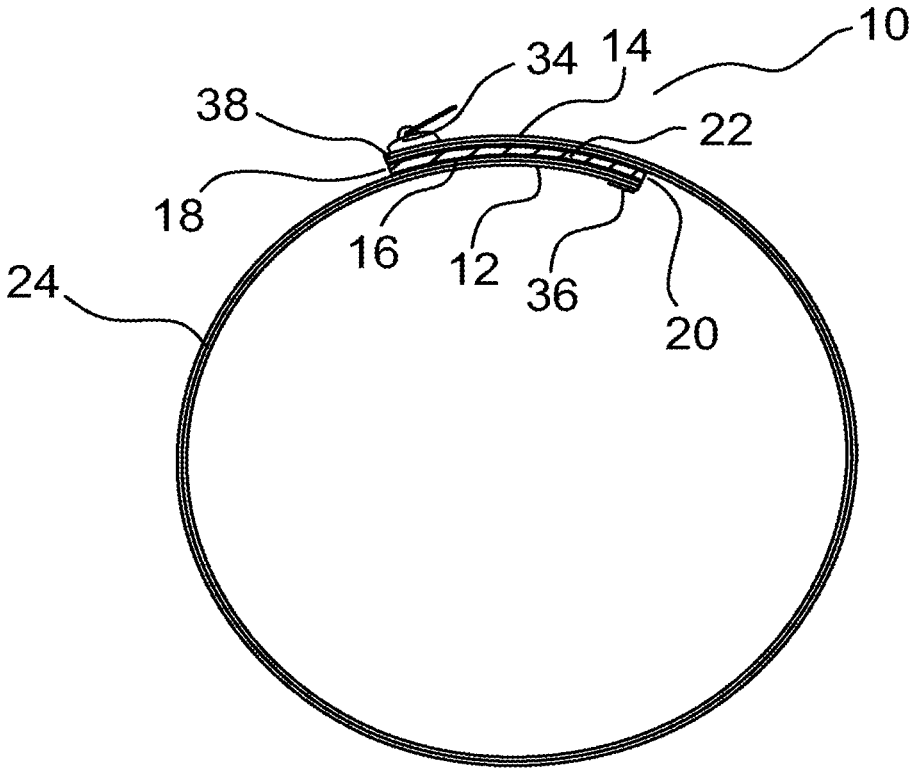
FIG. 10 is a top plan view of the first embodiment of sealed zipper assembly illustrated in FIG. 8.
Figure 11:
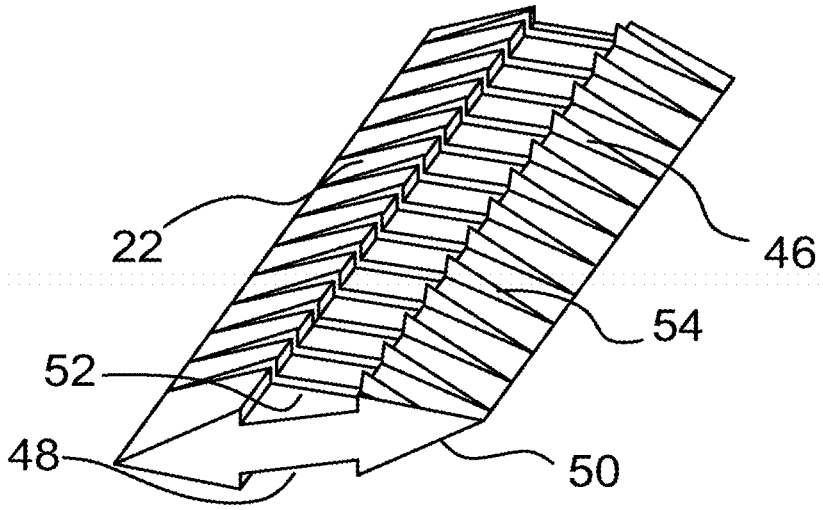
FIG. 11 is a perspective view of a sealing element illustrated in FIG. 9

Structure and Relationship of Parts:

Referring to FIG. 10, first embodiment 10 of sealed zipper assembly includes a first zipper segment 12 and a second zipper segment 14 in overlapping relation to create a sealing zone 16. Referring to FIG. 6 and FIG. 9, sealing zone 16 can be viewed as forming a tunnel. Referring to FIG. 10, in this regard, sealing zone 16 has an exterior opening 18 and an interior opening 20. Referring to FIG. 9 and FIG. 10, a sealing element 22 is positioned in sealing zone 16 to prevent leakage between first zipper segment 12 and second zipper segment 14. Referring to FIG. 11, sealing element 22 is illustrated. Referring to FIG. 9 and FIG. 10, sealing element 22 is resiliently deformable and is compressed within sealing zone 16 by first zipper segment 12 and second zipper segment 14. Referring to FIG. 10, it will be noted that with first embodiment 10 first zipper segment 12 and second zipper segment 14 are part of a single interlocking zipper fastener 24 and create a single sealing zone, previously identified as sealing zone 16. As will hereinafter be illustrated and described with reference to embodiment variations there can be more than one interlocking zipper fastener and more than one sealing zone.

Figure 7:
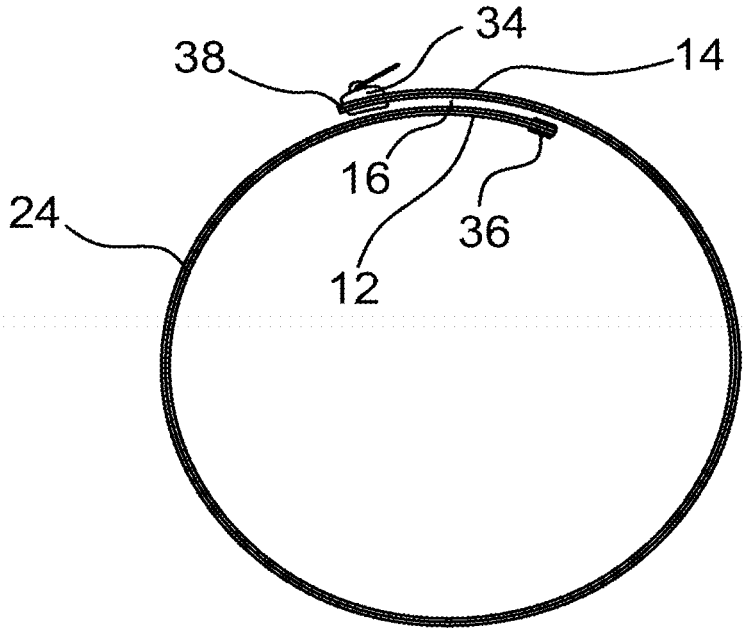
FIG. 7 is a top plan view of the first embodiment of sealed zipper assembly illustrated in FIG. 1.

Referring to FIG. 1 through FIG. 5 and FIG. 8, interlocking zipper fastener 24 having a first series of interlocking teeth 26 supported on a band 28 and a second series of interlocking teeth 30 supported on a band 32. At least one slider 34 is provided. Referring to FIG. 7 and FIG. 10, interlocking zipper fastener 24 has a first end 36 that serves as first zipper segment 12 and a second end 38 that serves as second zipper segment 14 in this embodiment.

Figure 2:
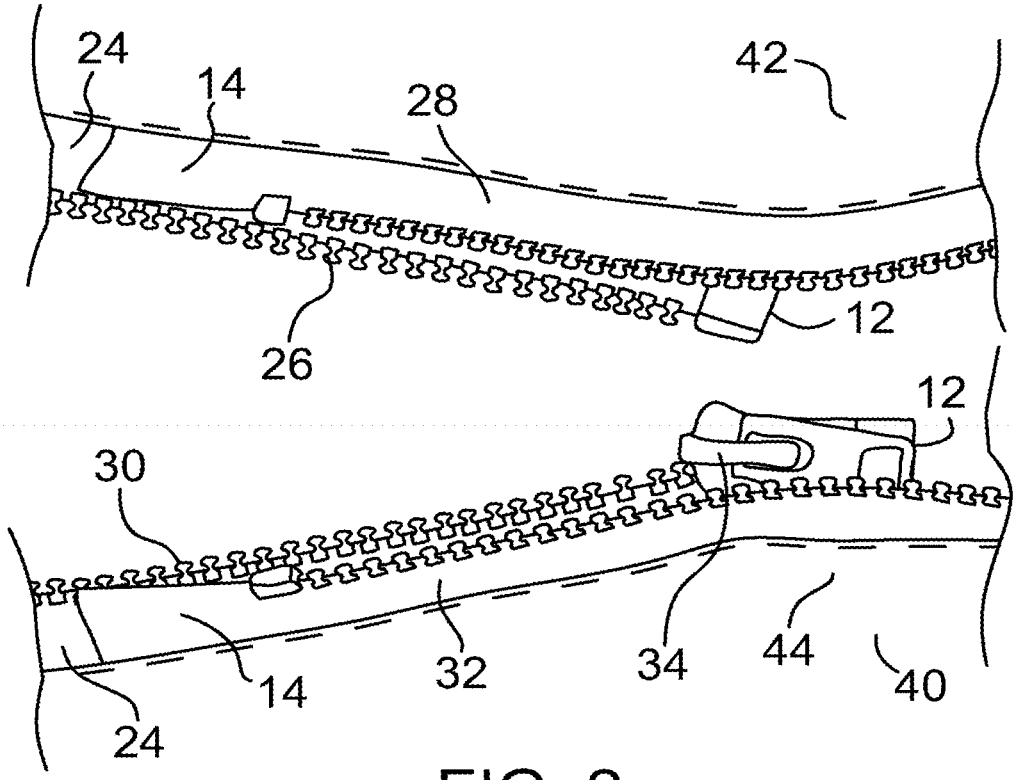
FIG. 2 is a front elevation view of the first embodiment of sealed zipper assembly illustrated in FIG. 1, in an open position.

Referring to FIG. 2, a garment body 40 made with waterproof fabric consists of a first or upper discrete body component 42 and a second or lower discrete body component 44. Interlocking zipper fastener 24 is in a circular configuration that enables first discrete body component 42 to be separated from second discrete body component 44. Referring to FIG. 2, band 28 supporting first series of interlocking teeth 26 constituting a first half of interlocking zipper fastener 24 is secured to first discrete body component 42 in a generally circular configuration to form a first half of first zipper segment 12 and a first half of second zipper segment 14 in overlapping relation. Similarly, band 32 supporting second series of interlocking teeth 30 constituting a second half of interlocking zipper fastener 24 is secured to second discrete body 44 component in a generally circular configuration to form a second half of the first zipper segment 12 and a second half of the second zipper segment 14 in overlapping relation.

Figure 1:
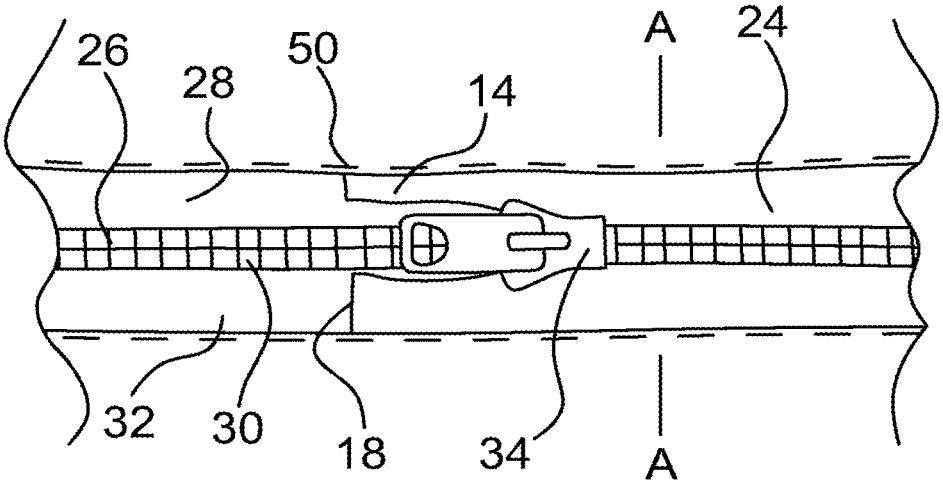
FIG. 1 is a front elevation view of a first embodiment of sealed zipper assembly in a closed position.
Figure 3:
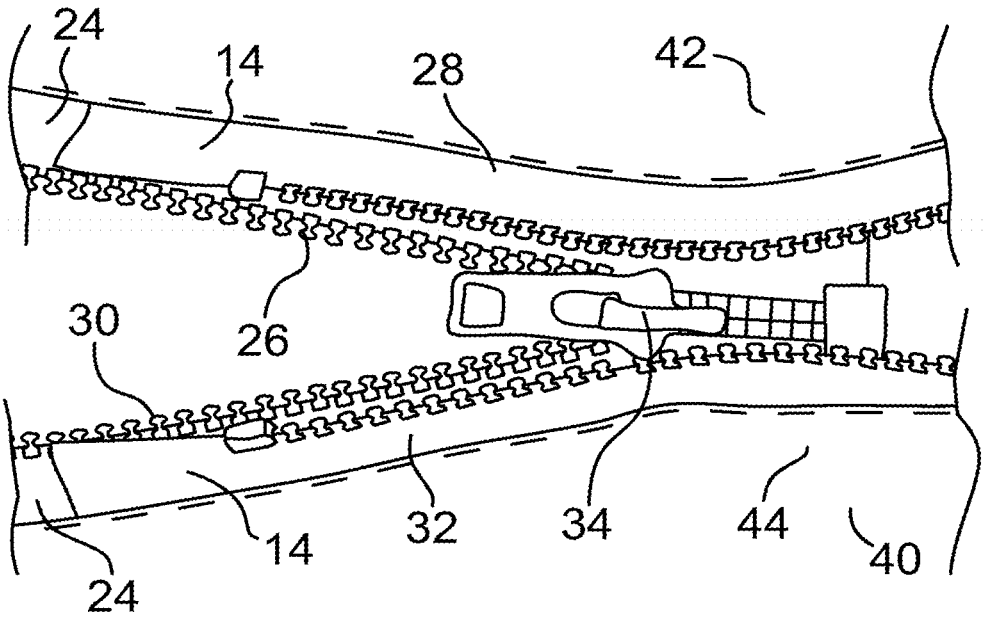
FIG. 3 is a front elevation view of the first embodiment of sealed zipper assembly illustrated in FIG. 1, in a slider starting position.
Figure 4:
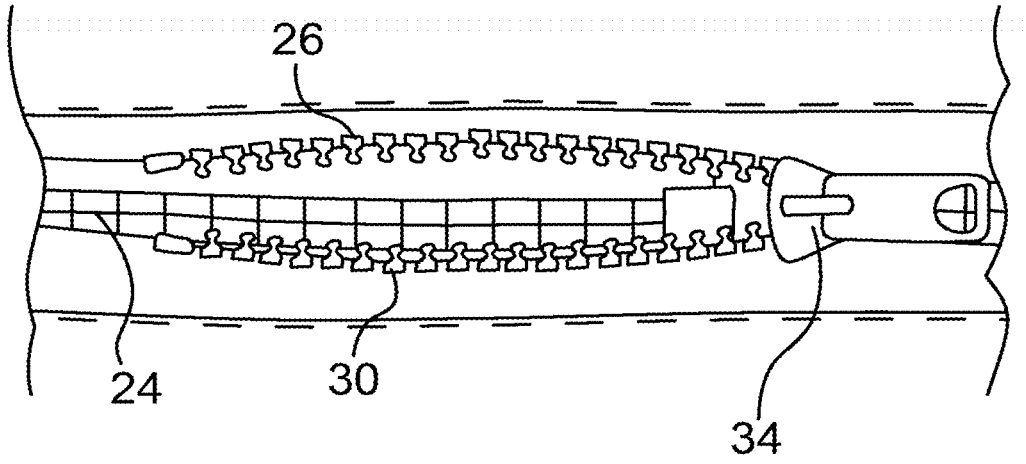
FIG. 4 is a front elevation view of the first embodiment of sealed zipper assembly illustrated in FIG. 1, in a slider closing position.
Figure 8:
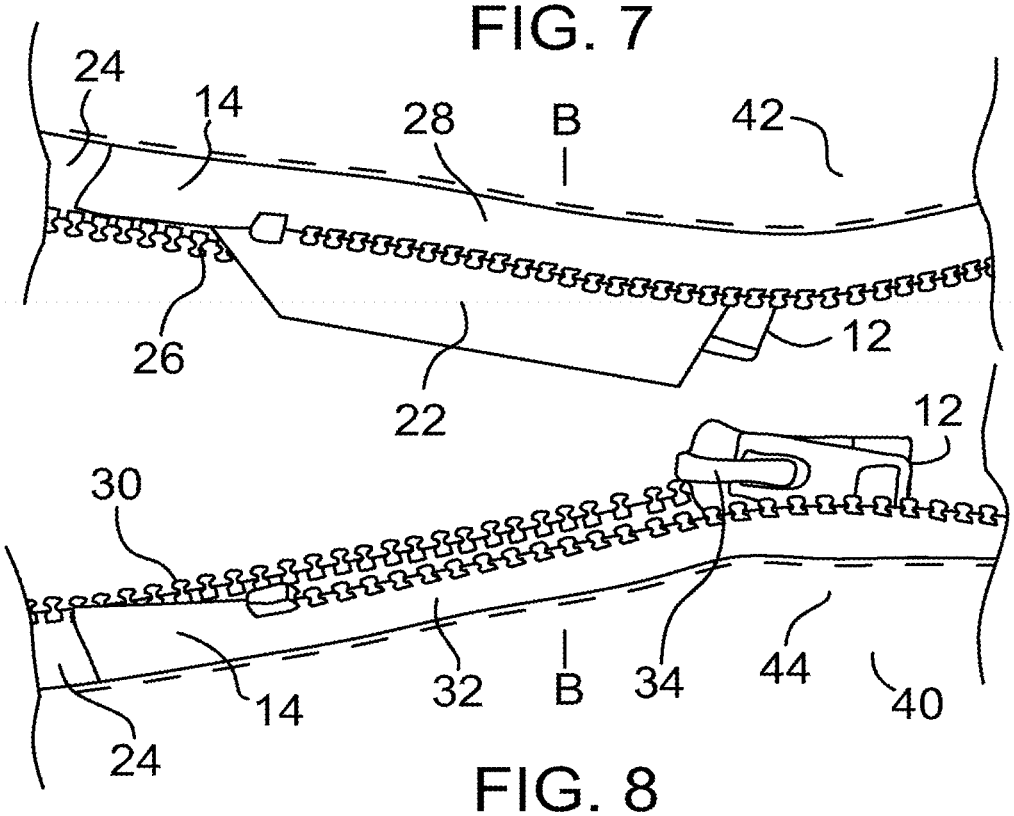
FIG. 8 is a front elevation view of the first embodiment of sealed zipper assembly illustrated in FIG. 1, in an open position with a sealing element.

Referring to FIG. 3, slider 34 is used to slides along interlocking zipper fastener 24 in a first direction to bring first series of interlocking teeth 26 and second series of interlocking teeth 30 into engagement as illustrated in FIG. 1. Referring to FIG. 4, slider 34 slides along interlocking zipper fastener 24 in a second direction to disengage first series of interlocking teeth 26 and second series of interlocking teeth 30 to disengage interlocking zipper fastener 24, as illustrated in FIG. 2. Referring to FIG. 6, FIG. 7, FIG. 9 and FIG. 10, as slider 34 interlocks first series of interlocking teeth 26 and second series of interlocking teeth 30, it completes first zipper segment 12 and second zipper segment 14, the overlapping of which creates sealing zone 16. Sealing zone 16 is then ready to receive sealing element 22. Referring to FIG. 8, sealing element 22 has ridges 46 that assist in sealing. Sealing element 22 also has a first channel 48 on a first face 50 and a second channel 52 on a second face 54. Referring to FIG. 9, First channel 48 receives interlocked teeth 56 of first zipper segment 12 and second channel 52 receives interlocked teeth 58 of second zipper segment 14.

Operation:

Referring to FIG. 2, band 28 supporting first series of interlocking teeth 26 constituting a first half of interlocking zipper fastener 24 is secured to first discrete body component 42 in a generally circular configuration to form a first half of first zipper segment 12 and a first half of second zipper segment 14 in overlapping relation. Band 32 supporting second series of interlocking teeth 30 constituting a second half of interlocking zipper fastener 24 is secured to second discrete body 44 component in a generally circular configuration to form a second half of the first zipper segment 12 and a second half of the second zipper segment 14 in overlapping relation. Referring to FIG. 3, slider 34 slides along interlocking zipper fastener 24 in a first direction to bring first series of interlocking teeth 26 and second series of interlocking teeth 30 into engagement as illustrated in FIG. 1. Referring to FIG. 6 and FIG. 7, as slider 34 interlocks first series of interlocking teeth 26 and second series of interlocking teeth 30, it completes first zipper segment 12 and second zipper segment 14 the overlapping of which creates sealing zone 16. FIG. 9 and FIG. 10, sealing element 22 is compressed within sealing zone 16 by first zipper segment 12 and second zipper segment 14.

Variations:

There will hereinafter be described variations that may be made to the first embodiment. With each variation, elements that are identical to the first embodiment will be identified by identical reference numerals. Only those aspects that differ from the first embodiment will be described.

Figure 12:
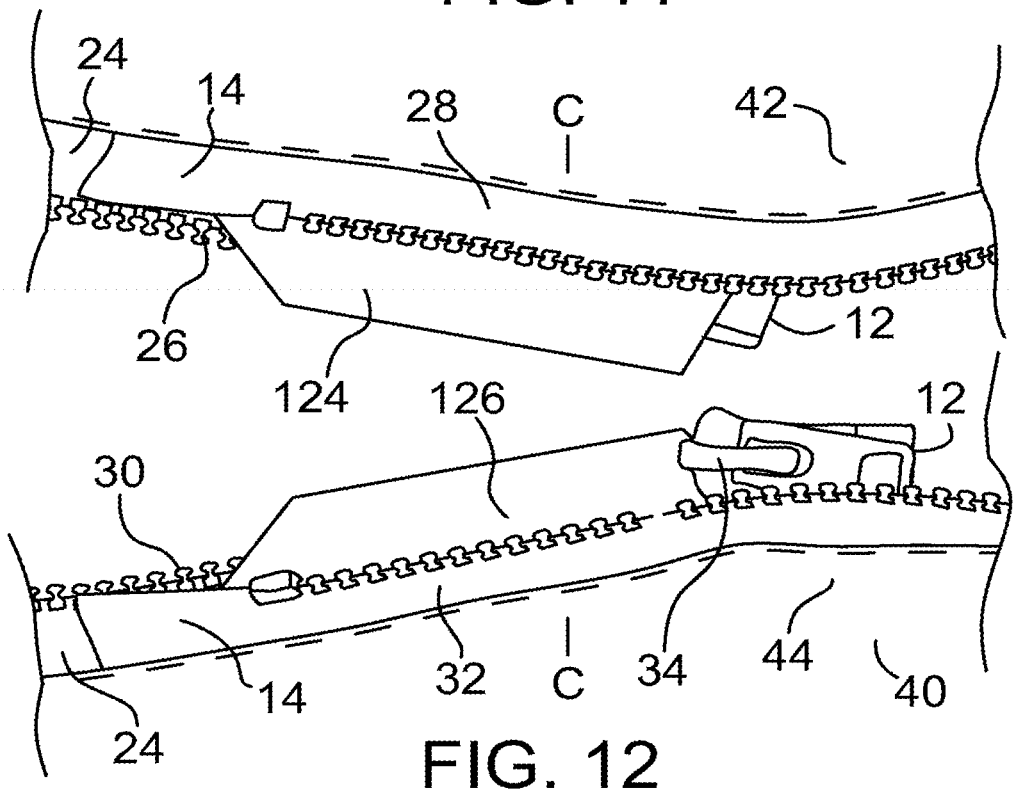
FIG. 12 is a front elevation view of a second embodiment of sealed zipper assembly in an open position.
Figure 13:
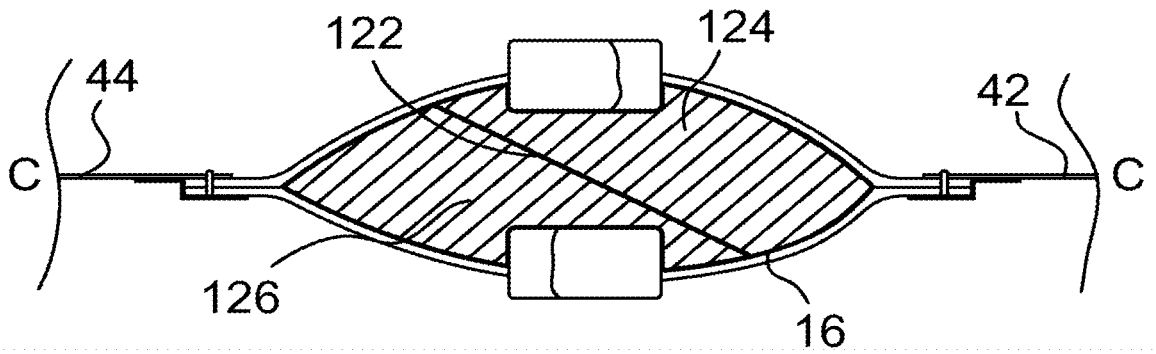
FIG. 13 is a section view of the second embodiment of sealed zipper assembly taken along section lines C-C of FIG. 12.
Figure 14:
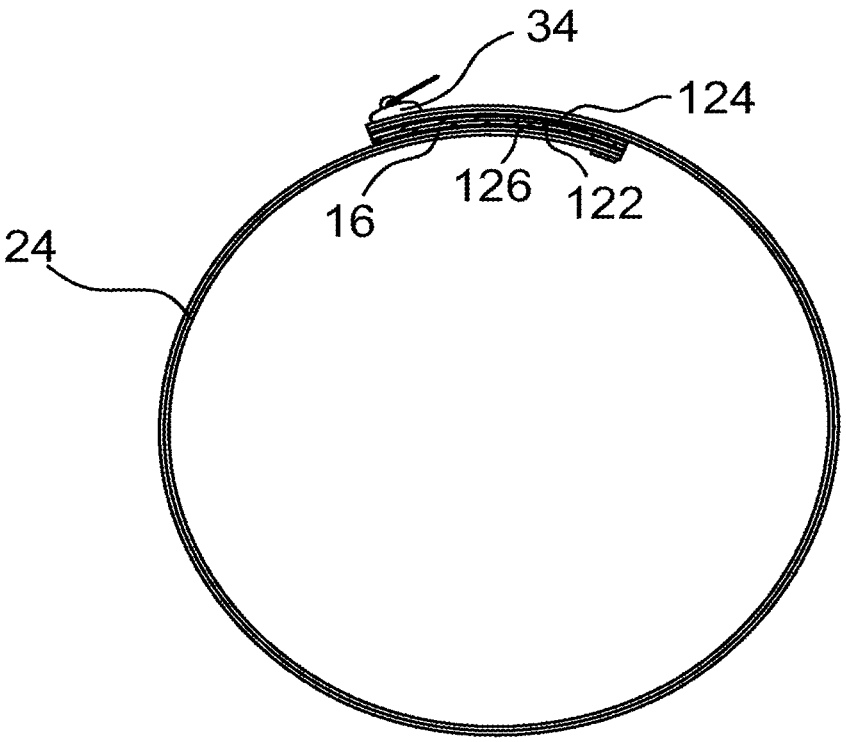
FIG. 14 is a top plan view of the second embodiment of sealed zipper assembly illustrated in FIG. 12.
Figure 15:
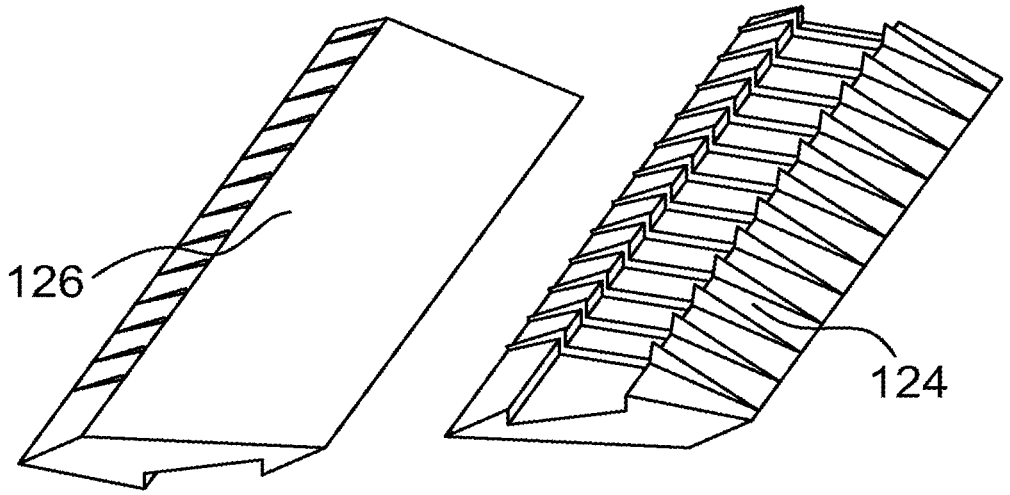
FIG. 15 is an exploded perspective view of a sealing element illustrated in FIG. 13.

The first embodiment illustrated a single sealing element 22. Referring to FIG. 15, there is illustrated an alternative sealing element 122 that has a first seal component 124 and a second seal component 126. Referring to FIG. 12, first seal component 124 is wedged into and held by friction or otherwise secured to first discrete body component 42. Second seal component 126 is wedged into and held by friction or otherwise secured to second discrete body component 44. Referring to FIG. 13 and FIG. 14, when interlocking zipper fastener 24 is closed, first seal component 124 and second seal component 126 are forced together to form sealing element 122 which fills sealing zone 16.

Figure 16:
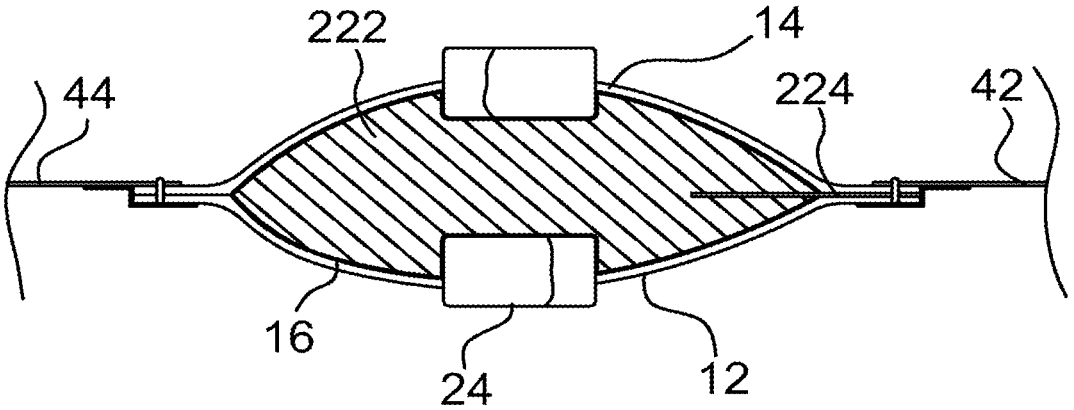
FIG. 16 is a section view of a third embodiment of sealed zipper assembly.
Figure 17:
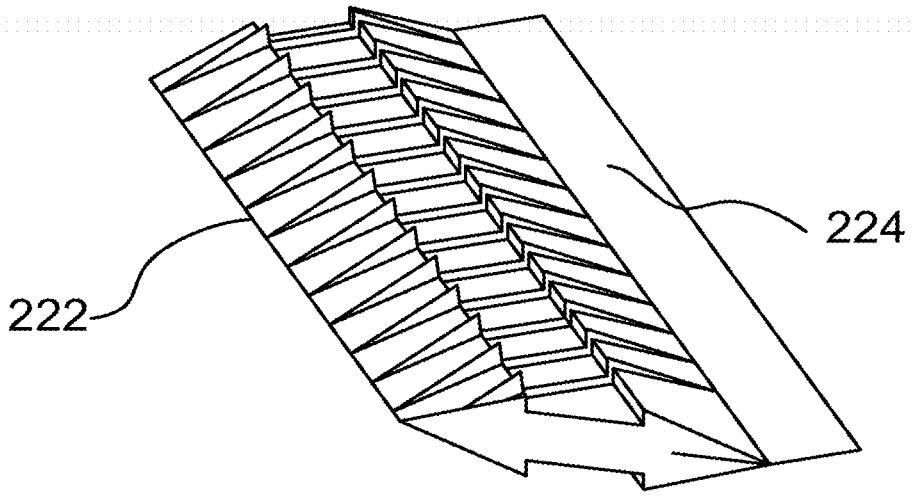
FIG. 17 is a perspective view of a sealing element illustrated in FIG. 16.

In the first embodiment, sealing element 22 was held in place by friction and was removable. Referring to FIG. 16 and FIG. 17, alternative sealing element 222 has a fabric strip 224 moulded into the elastomeric foam. Fabric strip 224 is used to secure alternative sealing element 222 to first discrete body component 42. This is done by stitching through fabric strip 224. Fabric strip 224 serves to anchor alternative sealing element 222 to first discrete body component 42 in a desired position where sealing zone 16 is formed by the overlapping of first zipper segment 12 and second zipper segment 14 of interlocking zipper fastener 24. It will be appreciated that there are other ways to secure alternative sealing element within sealing zone 16.

Figure 18:
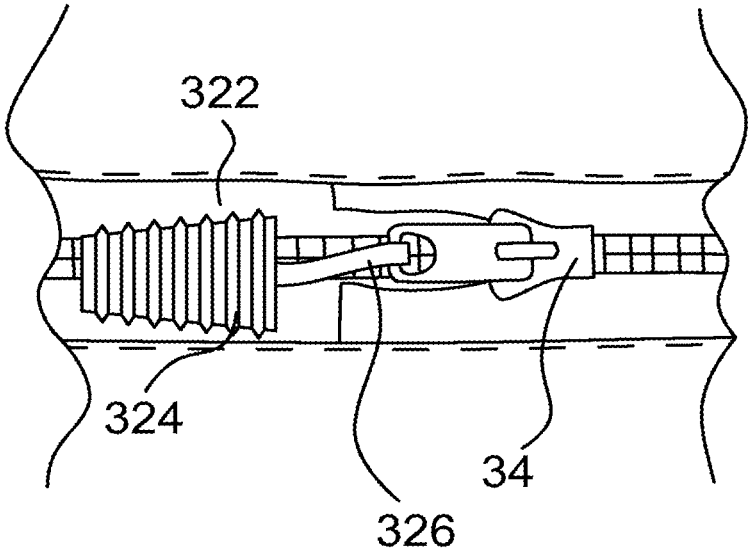
FIG. 18 is a front elevation view of a fourth embodiment of sealed zipper assembly in a closed position, prior to sealing.
Figure 19:
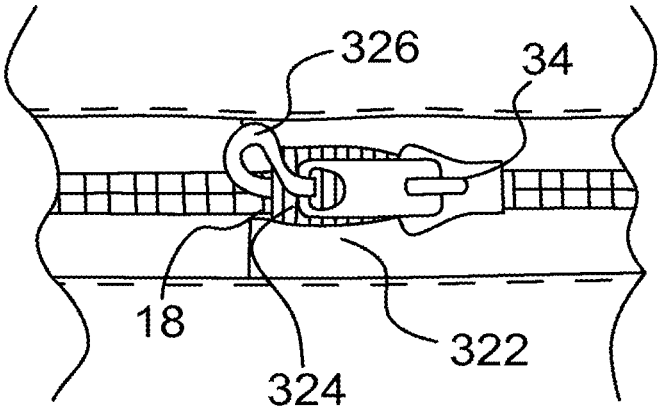
FIG. 19 is a front elevation view of the fourth embodiment of sealed zipper assembly illustrated in FIG. 18, with sealing element inserted into the sealing zone.
Figure 20:
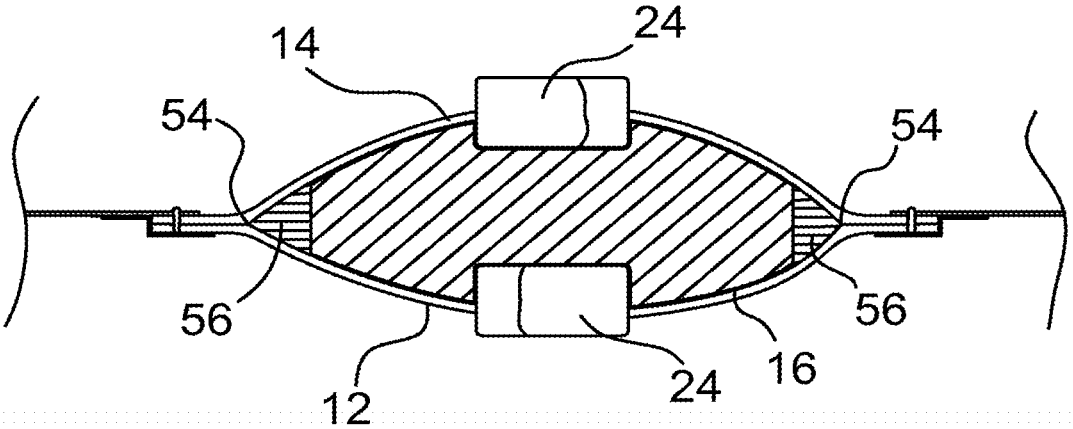
FIG. 20 is a section view of a fifth embodiment of sealed zipper assembly.

In the first embodiment, sealing element 22 was elastomeric foam. Referring to FIG. 18 and FIG. 19 an alternative sealing element 322 is illustrated. Referring to FIG. 18, sealing element 322 is a plug 324 that is suspended by a tether 326 from slider 34 when not in use. Referring to FIG. 19, plug 324 is intended to be inserted into exterior opening 18 of sealing zone 16 to seal sealing zone 16. It is preferred that plug 324 have a surface profile, such as ribs or ridges, to enhance both the sealing capacity and the holding capacity of plug 324. It will be appreciated that there are other raised surface profiles that would similarly serve this purpose.

Figure 22:
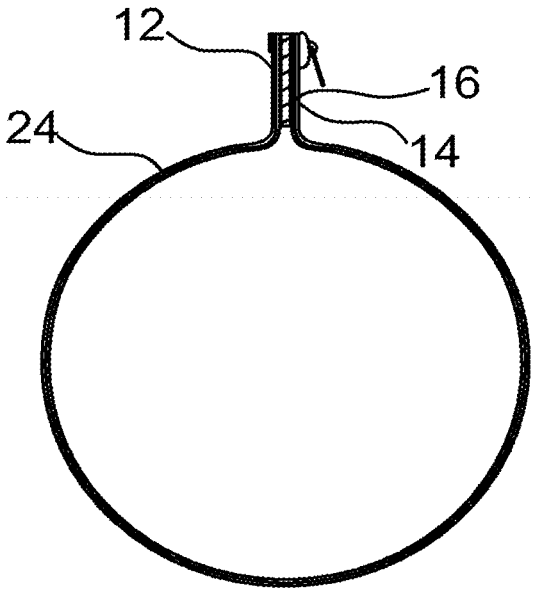
FIG. 22 is a top plan view of a seventh embodiment of sealed zipper assembly.

In the first embodiment, first zipper segment 12 and second zipper segment 14 are positioned substantially parallel to interlocking zipper fastener 24. Referring to FIG. 22, first zipper segment 12 and second zipper segment 14 which form sealing zone 16, can be configured so that they project outwardly or radially from interlocking zipper fastener 24.

Figure 23:
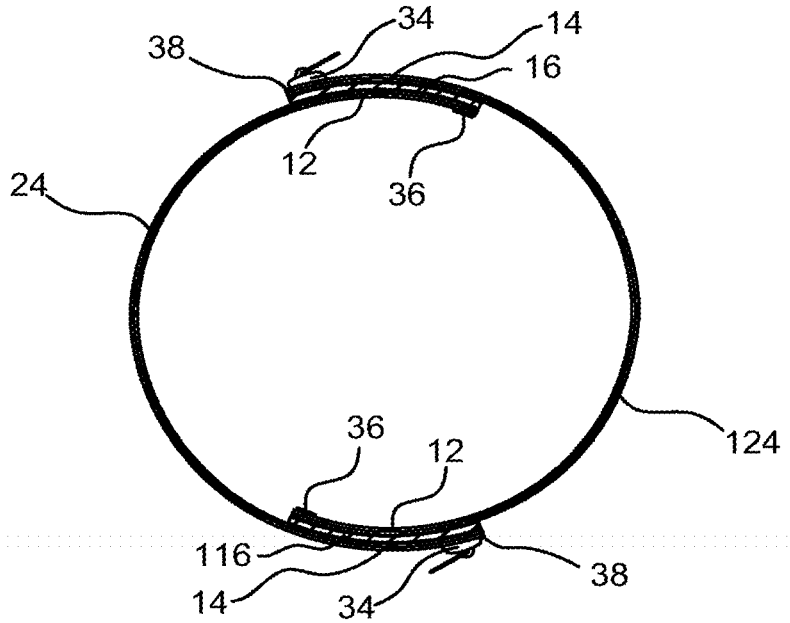
FIG. 23 is a top plan view of an eighth embodiment of sealed zipper assembly.

In the first embodiment, there was only one interlocking zipper fastener 24 and only one sealing zone 16. Referring to FIG. 23, there is shown a configuration that has more than one interlocking zipper fastener 24 and more than one sealing zone 16. With this configuration, first end 36 of one interlocking zipper fastener 24 serves as first zipper segment 12 and second end 38 of another interlocking zipper fastener 124 serves as second zipper segment 14 to create a first sealing zone 16. In addition, first end 36 of interlocking zipper fastener 124 serves as first zipper segment 12 and second end 38 of interlocking zipper fastener 24 serves as second zipper segment 14 to create a second sealing zone 116. It will be appreciated that although two interlocking zipper fasteners 24 and 124 have been illustrated in a circular configuration more than two interlocking zipper fastener could also be arranged in a circular configuration in a like manner.

Figure 24:
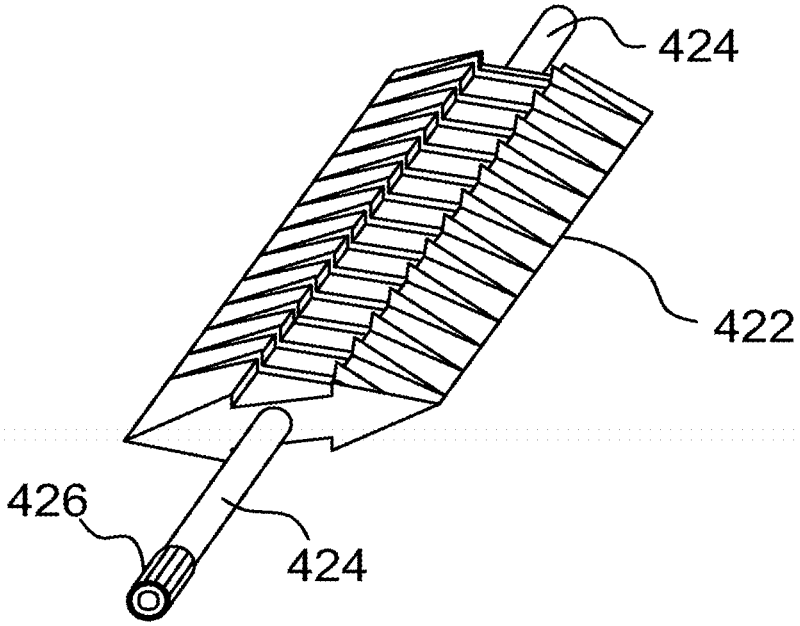
FIG. 24 is a perspective view of an alternative sealing element having an air transfer tube.

It is not unusual for a garment intended for use in water, such as garment body 40 to have air transfer valves, to provide for air movement. Referring to FIG. 24, alternative sealing element 422 is shown with an air transfer tube 424 extending through the body of alternative sealing element 422. Air transfer tube 424 allows for movement of air in and out of garment body 40. When garment body 40 is to be submerged in water or another liquid, a closure valve 426 can be used to close air transfer tube 424.

Figure 25:
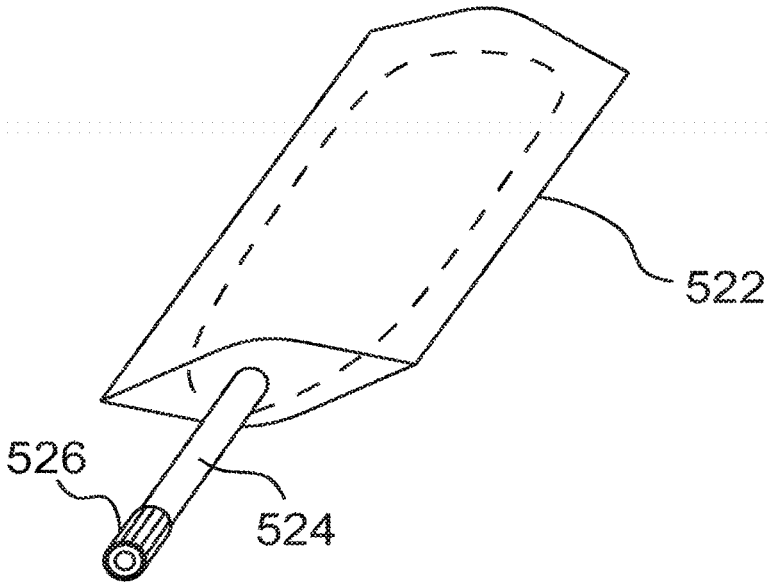
FIG. 25 is a perspective view of an inflatable sealing element.

In the first embodiment, sealing element 22 was compressed. Referring to FIG. 25, a bladder like alternative sealing element 522 is shown which is expandable like a balloon. Alternative sealing element 522 has a tube 524 into which a user may blow to inflate alternative sealing element 522 and a closure valve 526 that is to maintain air pressure within alternative sealing element 522. When expanded, alternative sealing element 522 expands to occupy sealing zone 16.

Figure 26:
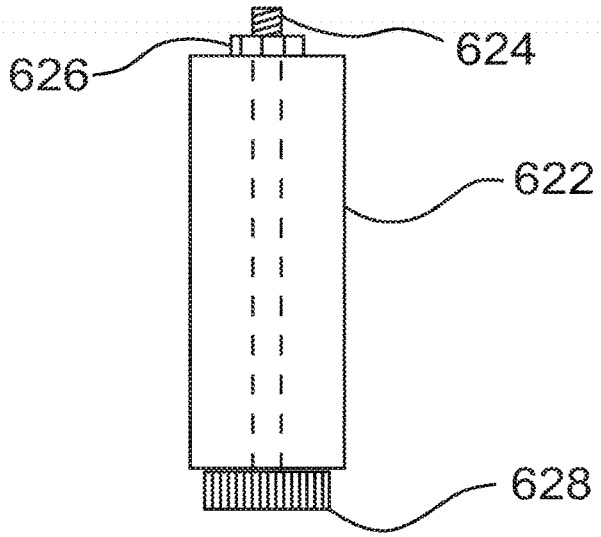
FIG. 26 is a front elevation view of an alternative sealing element that is compressible in a lengthwise direction.

Another alternative sealing element is positioned between two clamping elements with at least one of the clamping elements being movable toward and away from another of the clamping elements. As the clamping elements are moving closer together, the sealing element is forced outwardly to seal the sealing zone. Referring to FIG. 26, one such clamping configuration is illustrated. Alternative sealing element 622 has a bolt 624 that runs through it lengthwise. There is a nut 626 on one end of the bolt 624 and a twist knob 628 on the other end of bolt 624. Nut 626 serves as one clamping element and twist knob 626 serves as another clamping element. Turning twist knob 628 causes axial movement that compresses alternative sealing element 622 between twist knob 628 and nut 626. When compressed, alternative sealing element 622 expands outwardly increasing the circumference of alternative sealing element 622 until alternative sealing element 622 seals the sealing zone.

Advantages:

The method of sealing a zipper closure and the sealed zipper assemblies described above provide a number of advantages:

1. It is relatively simple to use, when compared with the Kallionpaa reference.
2. It is less expensive to manufacture, when compared with the Kallionpaa reference.
3. It has less bulk and is more comfortable to wear, when compared with the Kallionpaa reference.
4. It has greater flex and is less subject to material fatigue, when compared with the Kallionpaa reference.
5. It will work with any most, if not all, brands and styles of dry zipper.
6. It has a degree of adjustability to fit difference circumferences by increasing or decreasing the amount of overlap, whereas the Kallionpaa reference is an endless loop that must be made to a specific circumference.
7. If air transfer is desired, an air transfer tube can be positioned through the sealing element to avoid making extra holes in garment 40 to accommodate air transfer valves.

Cautionary Warnings:

It will be appreciated that not all zippers can function in a liquid environment. In order to avoid leakage, one has to use a waterproof zipper. It will also be appreciated that there are a number of different styles of waterproof zippers. Suitable waterproof zippers will be known to persons familiar with underwater diving and will, therefore, not be listed here.

In order for the sealing elements described above to be effective, there are a number of leakage points along stitches and seams that must be effectively sealed.

Figure 5:
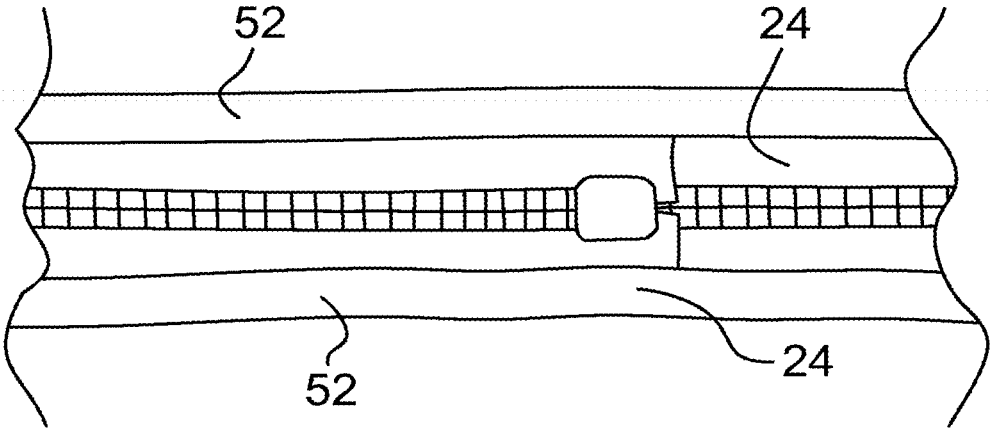
FIG. 5 is a rear elevation view of the first embodiment of sealed zipper assembly illustrated in FIG. 1, in a closed position.

Referring to FIG. 1, stitches 50 are used to secure interlocking zipper fastener 24 in place. Referring to FIG. 5, waterproof tape 52 is heat sealed or secured by adhesive to reverse side Referring to FIG. 20 and FIG. 21, sealing zone 16 has edge seams 54 that are subject to leakage. Referring to FIG.

Figure 21:
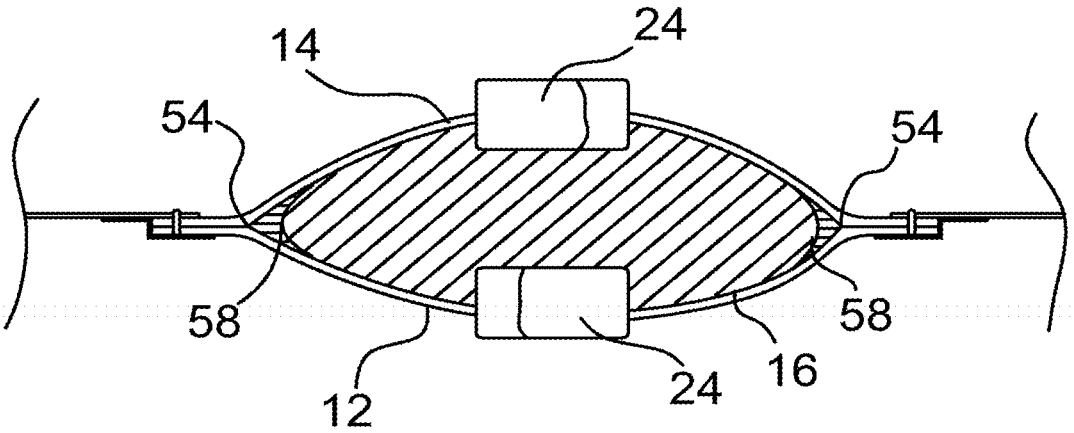
FIG. 21 is a section view of a sixth embodiment of sealed zipper assembly.

20, leakage can be addressed by sealing edge seams 54 with pliable edge moulding 56. Referring to FIG. 21, leakage can also be addressed by sealing edge seams 54 by using a bead 58 of polymer caulking compound, In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be one and only one of the elements.

The illustrated embodiments have been set forth only as examples and should not be taken as limiting a purposive interpretation of the claims.

That which is claimed is:

1. A sealed zipper system, comprising:

a first zipper end of the zipper system and a second zipper end of the sealed zipper system, wherein the first zipper end overlaps the second zipper end at an overlapping region defining a sealing zone; and a sealing element removeably positionable in the sealing zone along an axis, wherein the sealing element is configured to form a seal between the first zipper end and the second zipper end.

2. The sealed zipper system of claim 1, wherein the sealing element is a resiliently deformable sealing element that is compressed within the sealing zone at least in a direction perpendicular to the axis of the sealing zone.

3. The sealed zipper system of claim 1, wherein the sealing element is an expandable sealing element that expands to occupy the sealing zone.

4. The sealed zipper system of claim 1, wherein the sealing element is a plug.

5. The sealed zipper system of claim 4, wherein the plug further comprises a tether.

6. The sealed zipper system of claim 1, wherein the sealing element is configured prevent leakage between the first end and the second end.

7. The sealed zipper system of claim 1, wherein the sealed zipper system comprises a waterproof zipper fastener comprising:

a first series of interlocking teeth supported on a first band;

a second series of interlocking teeth supported on a second band; and a slide that is slidable in a first direction and a second direction, wherein the slide slidable in the first direction brings the first series of interlocking teeth and the second series of interlocking teeth into engagement, and wherein the slide slidable in the second direction disengages the first series of interlocking teeth and the second series of interlocking teeth.

8. The sealed zipper system of claim 1, further comprising a sealing element actuator, wherein the sealing element actuator is axially movable, and wherein movement of the sealing element actuator selectively expands the sealing element outwardly and perpendicular to an axial direction of the actuator's movement.

9. The sealed zipper system of claim 8, wherein the sealing element actuator comprises a shaft and a clamping element movable along the shaft, wherein the clamping element is configured to selectively compress the sealing element, and wherein compression of the sealing element by the clamping element expands the sealing element outwardly.

10. The sealed zipper system of claim 9, wherein the clamping element comprises a nut and a twist knob, wherein the twist knob is axially movable along the shaft toward the nut to selectively compress the sealing element.

11. The sealed zipper system of claim 1, wherein the sealing zone comprises a plurality of edge seams, and wherein the sealed zipper system further comprises an edge seal sealing at least one edge seam of the plurality of edge seams.

12. The sealed zipper system of claim 11, wherein the edge seal is pliable.

13. The sealed zipper system of claim 11, wherein the edge seal is fixed relative to a zipper fastener.

14. The sealed zipper system of claim 11, wherein the edge seal is a first edge seal of a plurality of edge seals, and wherein each edge seam of the plurality of edge seams comprises a corresponding edge seal of the plurality of edge seals.

15. A method of closing a zipper system, the method comprising:

providing a first zipper end of the zipper system and a second zipper end of the zipper system, wherein the first end overlaps the second end at an overlapping region defining a sealing zone; and positioning a removeable sealing element in the sealing zone along an axis, wherein the sealing element is configured to form a seal between the first end and the second end.

16. The method of claim 15, wherein the sealing element is a resiliently deformable sealing element, and wherein positioning the sealing element into the sealing zone comprises compressing the sealing element within the sealing zone.

17. The method of claim 15, wherein providing the first zipper end and the second zipper end further comprises providing:

a first series of interlocking teeth supported on a first band;

a second series of interlocking teeth supported on a second band; and a slide that is slidable in a first direction and a second direction, wherein the slide slidable in the first direction brings the first series of interlocking teeth and the second series of interlocking teeth into engagement, and wherein the slide slidable in the second direction disengages the first series of interlocking teeth and the second series of interlocking teeth.

18. The method of claim 15, wherein the sealing element is an expandable sealing element, and wherein positioning the sealing element into the sealing zone comprises expanding the sealing element within the sealing zone.

19. The method of claim 15, wherein the sealing element is a plug, and wherein positioning the sealing element into the sealing zone comprises positioning at least a portion of the plug within the sealing zone.

20. The method of claim 15, wherein the sealing zone comprises edge seams, wherein the zipper system further comprises an edge seal sealing at least one of the edge seams, and wherein positioning the sealing element into the sealing zone comprises contacting the sealing element with the edge seal.

* * * * *